US008132979B2

(12) United States Patent
Orava

(10) Patent No.: US 8,132,979 B2
(45) Date of Patent: Mar. 13, 2012

(54) ASSEMBLY FOR CONSTRUCTING RESPONSIVE STRUCTURAL ELEMENTS

(75) Inventor: John E. Orava, Edgewood, IL (US)

(73) Assignee: Orava Applied Technologies Corporation, Albany, NY (US)

( * ) Notice: Subject to any disclaimer, the term of this patent is extended or adjusted under 35 U.S.C. 154(b) by 167 days.

(21) Appl. No.: 12/064,102

(22) PCT Filed: Oct. 7, 2006

(86) PCT No.: PCT/US2006/039580

§ 371 (c)(1),
(2), (4) Date: Feb. 19, 2008

(87) PCT Pub. No.: WO2007/044733

PCT Pub. Date: Apr. 19, 2007

(65) Prior Publication Data

US 2008/0219753 A1 Sep. 11, 2008

Related U.S. Application Data

(60) Provisional application No. 60/725,142, filed on Oct. 7, 2005.

(51) Int. Cl.
*F16B 7/18* (2006.01)

(52) U.S. Cl. ..... 403/292; 52/849; 52/655.1; 52/302.1; 285/125.1

(58) Field of Classification Search ..... 52/848, 52/849, 655.1, 655.2, 81.3, 220.1, 220.2, 52/220.3, 302.1; 403/292, 297, 312, 308; 135/909; 157/561 A, 602; 285/137.11, 139.1, 285/142.1, 191, 125.1, 205–210
See application file for complete search history.

(56) References Cited

U.S. PATENT DOCUMENTS

| | | | | | |
|---|---|---|---|---|---|
| 2,053,462 | A | * | 9/1936 | Chaplin | 52/655.1 |
| 2,639,931 | A | * | 5/1953 | Kandle | 403/292 |
| 2,658,776 | A | * | 11/1953 | Wilcox | 52/653.2 |
| 3,268,252 | A | | 8/1966 | Rolland | |
| 3,353,852 | A | * | 11/1967 | Wood | 403/189 |
| 3,360,285 | A | * | 12/1967 | Huckshold | 403/292 |
| 3,494,640 | A | * | 2/1970 | Brown et al. | 285/115 |
| 3,547,475 | A | * | 12/1970 | Gingher | 403/297 |
| 3,946,916 | A | * | 3/1976 | Lawrence | 224/262 |
| 4,068,346 | A | * | 1/1978 | Binder | 16/110.1 |
| 4,070,119 | A | * | 1/1978 | Duer | 403/12 |
| 4,088,414 | A | * | 5/1978 | Fallein | 403/282 |
| 4,100,713 | A | * | 7/1978 | Shoe | 52/655.1 |
| 4,491,437 | A | * | 1/1985 | Schwartz | 403/172 |

(Continued)

FOREIGN PATENT DOCUMENTS

FR 1039734 10/1953

(Continued)

*Primary Examiner* — Robert Canfield
*Assistant Examiner* — Babajide Demuren
(74) *Attorney, Agent, or Firm* — Schmeiser, Olsen & Watts, LLP

(57) ABSTRACT

The invention is an assembly for use in construction. In one embodiment, the invention is an assembly for connecting structural elements including an engaging member, a coupling member, and an elongate member. In another embodiment, the invention is a manifold assembly for use in construction including a manifold, an engaging member, and an elongate member. In yet another embodiment, the invention is structural assembly having dynamic constructive elements, manifolds, and a controller, wherein the controller regulates the environment within cavities of the dynamic constructive elements and conduits of the manifolds.

9 Claims, 19 Drawing Sheets

U.S. PATENT DOCUMENTS 4,516,376 A * 5/1985 King ..... 52/655.1
4,671,478 A * 6/1987 Schoenig et al. ..... 248/124.1
4,776,721 A 10/1988 Lange
5,059,057 A * 10/1991 Graef ..... 403/298
5,149,149 A * 9/1992 Wu ..... 285/402
5,860,253 A * 1/1999 Lapointe ..... 52/98
6,073,642 A * 6/2000 Huang ..... 135/114
6,216,413 B1 * 4/2001 Lapointe ..... 52/849
6,652,181 B1 * 11/2003 Geiger ..... 403/297
6,692,180 B2 * 2/2004 Wu ..... 403/292
6,840,702 B2 * 1/2005 Ko ..... 403/292
6,874,971 B2 * 4/2005 Albaugh ..... 403/297
2004/0163357 A1 * 8/2004 Gregory et al. ..... 52/747.12
2007/0086852 A1 * 4/2007 Goad ..... 403/292
2008/0276998 A1 * 11/2008 Boyher et al. ..... 137/561 A

FOREIGN PATENT DOCUMENTS

FR 1039734 A * 10/1953
WO 01/40666 6/2001

* cited by examiner

ASSEMBLY FOR CONSTRUCTING RESPONSIVE STRUCTURAL ELEMENTS

CROSS REFERENCE TO RELATED APPLICATION

This application hereby claims the benefit of commonly owned pending U.S. Provisional Patent Application Ser. No. 60/725,142, for Connection Device(s) for Dynamic Constructive Elements, filed Oct. 7, 2005.

BACKGROUND OF THE INVENTION

The present invention relates to the field of connection devices for assembling structural elements. More specifically, the invention relates to connection devices for use with novel structural elements for use in construction applications.

Elements utilized in the construction of foundations, floors, walls, partitions, ceilings, and roofs are typically referred to as structural, or constructive, elements. Typical structural elements may be formed of lumber, concrete, brick, tile, block, metal, plywood, particleboard, flakeboard, insulation board, fiberglass, cellulose, sawdust, natural fibers, mineral fibers, drywall, plaster, stucco, and other similar materials known in the art.

Typical structural elements are static, or non-responsive, to their environment. For example, typical structural elements may allow harmful gases, vapors, bacteria, viruses, and spores to lodge within the structural elements and penetrate the structural elements into an internal environment within a structure. Such penetration may affect the health and well-being of occupants of a structure. This penetration may also damage objects within a structure. Additionally, such penetration may weaken the structure, eventually leading to structural failure.

Another drawback to the use of typical structural elements is their inability to dynamically react to, and compensate for environmental changes which may include, but are not limited to, changes in one or more of temperature, pressure, electromagnetic radiation, visible light, nuclear radiation, gases, vapors, liquids, particulate matter, biological agents, viruses, bacteria, poisons, explosive overpressure, and other changed external conditions.

As a result of the typical structural elements' inability to block or absorb harmful substances from entering an internal environment, or adjust to environmental changes, known structural elements typically do not provide an enhanced layer of security and safety. For example, typical structural elements may be incapable of protecting occupants of a building from a bioweapon attack. Similarly, many homes suffer from mold infestations that manifest themselves slowly until the home must be destroyed and rebuilt.

Such a system constructed of dynamic constructive elements will perform efficiently and as intended if the connections between the dynamic constructive elements provide not only structural integrity but also facilitate the environmental response of the system. Specifically, desirable assemblies for connecting structural elements enable communication of various components among the dynamic constructive elements in response to environmental stimuli. The various components communicated may include a gaseous component, a vapor component, a liquid component, a solid component, a particulate component, a bacterial component, a viral component, an electrical component, a force component, a pressure component, and combinations thereof.

Although it can be appreciated that connection devices or assemblies for construction have been in use for centuries, many connection devices commonly used in the construction of structures are not designed to enable such communication among constructive elements. Common connectors such as screws, nails, bolts, pins, flanges, welds, and the like do not allow for flow of gases, vapors, liquids, particulates, plasma, photons, electromagnetic fields, electric fields, or any other matter or energy among connected constructive components. Even those kinds of connectors that would allow the flow of energy or matter such as plumbing fittings are not designed to also provide structural support, corrosion resistance, fire resistance, and ease of installation in addition to their functional roles.

Further, even if some of the known connectors or fasteners could be adapted to function with dynamic constructive elements, such adaptation would require undue expense and time. As a result, there exists a need for ready-to-use, easily installed connecting elements for use with dynamic constructive elements that provide not only structural support but are also functionally designed to facilitate the dynamic response of such a system.

SUMMARY OF THE INVENTION

In one aspect the invention is an assembly for use in connecting or joining responsive construction elements. The assembly includes an engaging member defining a geometric shape, a channel and a coupling member defining a channel. The channels within the engaging member and coupling member facilitate the communication of various components (e.g., energy or matter) among responsive structural elements joined by the assembly.

In another aspect, the invention is a manifold assembly for use in construction including at least one manifold defining an internal cavity and having at least one receiving port and one or more conduits. The manifold assembly may also include one or more engaging members and one or more elongate members for securing responsive constructive elements to the manifold. The conduits within the manifolds and the structural connection elements used facilitate the communication of energy or matter among the responsive structural elements connected to the manifold.

In yet another aspect, the invention is a structural assembly (e.g., a house, hangar, etc.) formed from one or more constructive elements defining a cavity, one or more manifolds connected to the dynamic constructive elements, and one or more controllers for regulating the environment within the cavity of the dynamic constructive elements.

The foregoing, as well as other objectives and advantages of the invention and the manner in which the same are accomplished, is further discussed within the following detailed description and its accompanying drawings.

BRIEF DESCRIPTION OF THE DRAWING

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements.

DETAILED DESCRIPTION

Figure 1:
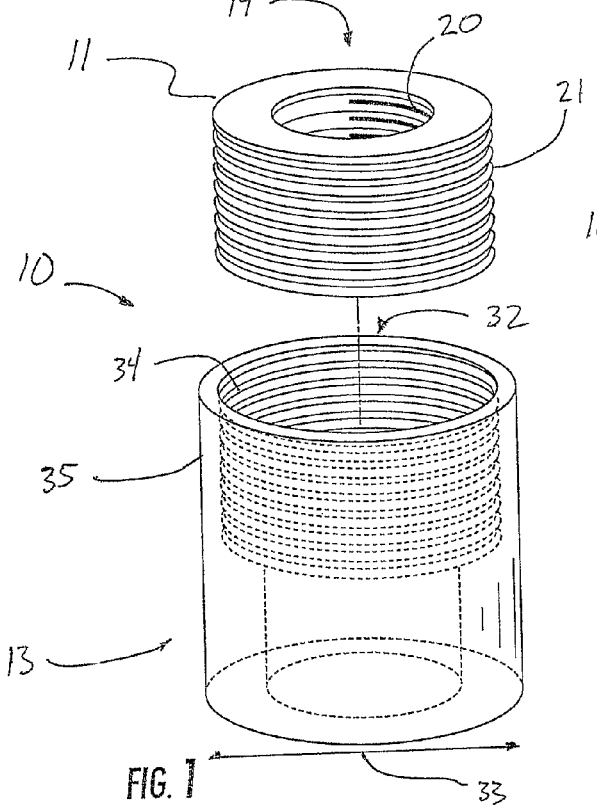
FIG. 1 is a perspective view of one embodiment of the assembly depicting an exploded view of an engaging member and an elongate member each having a circular cross-section.

The invention relates to the construction of structures and elements used in construction. More specifically, the invention relates to structural connection elements for use with dynamically responsive and interactive structural elements for improving structural performance, providing increased safety, improving comfort, and reducing operating costs.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

For ease of discussion, the apparatus will be described with reference to housing constructive elements. Those having ordinary skill in the art will recognize that the invention is applicable to constructive elements for structures other than housing structures, such as commercial buildings and other buildings known in the art. Similarly, the method will be described with respect to housing construction for ease of discussion. Those having ordinary skill in the art will recognize that the invention is applicable to construction of other buildings, such as commercial structures, and shall not be so limited.

The concept of a component or element of the invention being "between" two other components does not necessarily imply that the three components are contiguous (i.e., in intimate contact). Rather, as used herein, the concept of one component being between two other components is meant to describe the relative positions of the components within the assembly structure, respectively.

Those skilled in the art will also appreciate that the term "adjacent" refers to two or more, for example, components, that have a common border or are in close proximity to one another. Nevertheless, it will be understood that adjacent may or may not imply contact, but always implies the absence of anything of the same kind in between.

In one aspect, the invention is an assembly 10 for use in connecting structural elements. The connection of structural elements is accomplished through a combination of elements in this assembly 10. First is provided an engaging member 11 that serves to engage other structural elements. The engaging member 11 may be constructed in any geometric form or combination of geometric forms as necessary to correspond to the structural element it will engage. These geometric forms may have the shape of a square, a rectangle, a trapezoid, a circle, a sphere, an oval, a triangle, a pentagon, a hexagon, a heptagon, an octagon, or any other geometric shape known in the art, including a star shape.

Also provided is a coupling member 12 that serves to connect adjoining engaging members. The assemblies created by the combination of engaging members and coupling members 12 may then be used to join other structural elements. The joined structural elements may be an elongate member 13 having an internal cavity 32 and serving as a support element in a structure. The joined structural elements may also be a manifold 41 having an internal cavity 42 and at least one conduit 44 for further connecting a number of structural elements.

More specifically, one aspect of the invention is an assembly 10 for use in construction. The assembly 10 comprises a first engaging member 11 defining a geometric shape and at least one internal channel 14. In one embodiment, the internal channel 14 may extend longitudinally of the engaging member 11. In other embodiments, the internal channel 14 may extend laterally of the engaging member 11. In another embodiment, a plurality of channels 14 may extend non-planar with respect to one another. The first engaging member 11 includes an internal surface 20 and an external surface 21.

The assembly 10 may also include a second engaging member 11A defining a geometric shape and at least one internal channel 14. The second engaging member 11A likewise includes an internal surface 20 and an external surface 21.

This embodiment of the invention also provides a first coupling member 12 for connecting the first and second engaging members 11, 11A. The coupling member 12 includes an internal surface 22 and an external surface 23 and defines at least one internal channel 15. In one embodiment, the internal channel 15 may extend longitudinally of the coupling member 12. In other embodiments, the internal channel 15 may extend laterally of the coupling member 12. In another embodiment, a plurality of channels 15 may extend non-planar with respect to one another.

Figure 13:
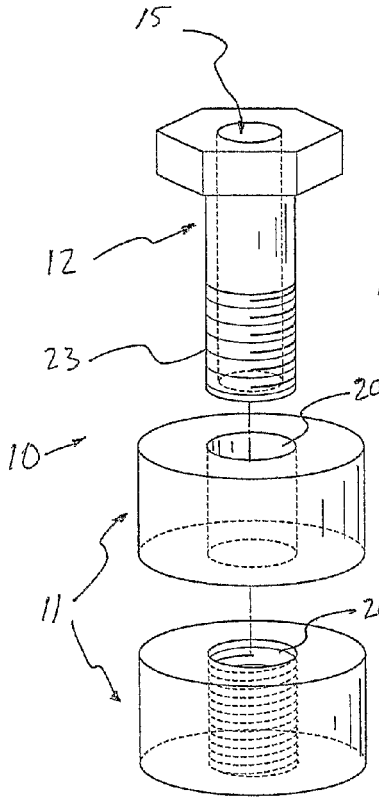
FIG. 13 is a perspective view of one embodiment of the assembly depicting an exploded view of two engaging members and a corresponding coupling member.
Figure 14:
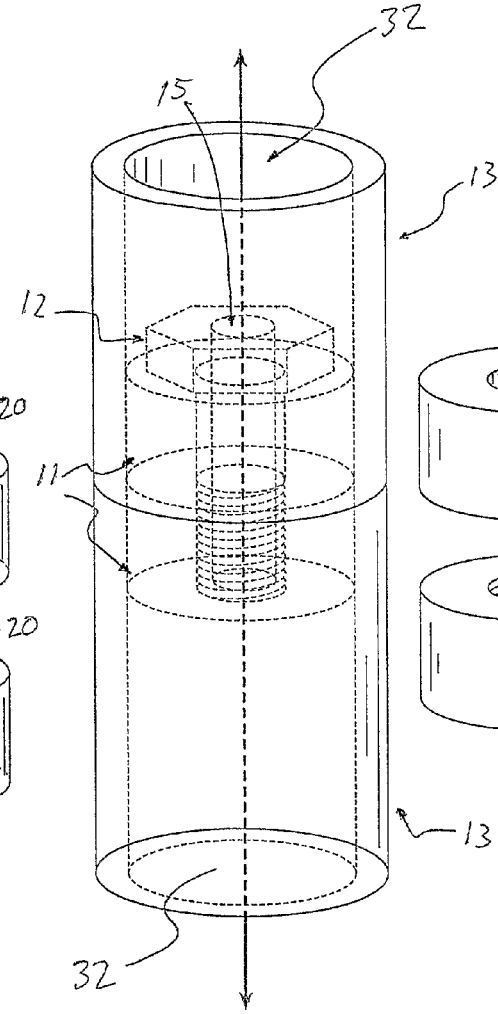
FIG. 14 is a perspective view of one embodiment of the assembly depicting an assembled view of two engaging members, two elongate members, and a corresponding coupling member.

As illustrated in FIGS. 13 and 14, the first engaging member 11 is secured to the second engaging member 11A by the first coupling member 12 extending through each channel 14, 14A of the first and second engaging members.

The geometric shape of the first and second engaging members 11, 11A may be in the form of a sphere, a square, a cube, a rectangle, a trapezoid, a circle, a cone, an oval, a triangle, a pentagon, a hexagon, a heptagon, an octagon, and combinations thereof.

Figure 8:
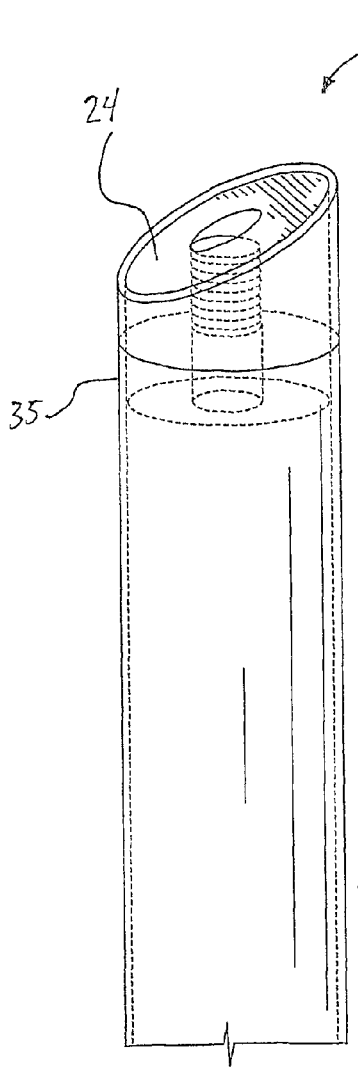
FIG. 8 is a perspective view of one embodiment of the assembly depicting an assembled view of an angled engaging member and an elongate member having a circular cross-section.

As shown in FIG. 8, at least one face 24 or end of the engaging member 11 may be chamfered or beveled. In another embodiment, the sides 25 of the engaging members 11, 11A are tapered as illustrated in FIGS. 11, 12, 19, and 20. The term "tapered" as used in conjunction with the present engaging members 11, 11A and elongate members 13, 13A refers to a top or bottom portion of the engaging member 11 or elongate member 13 becoming progressively smaller toward the opposite end.

Figure 18:
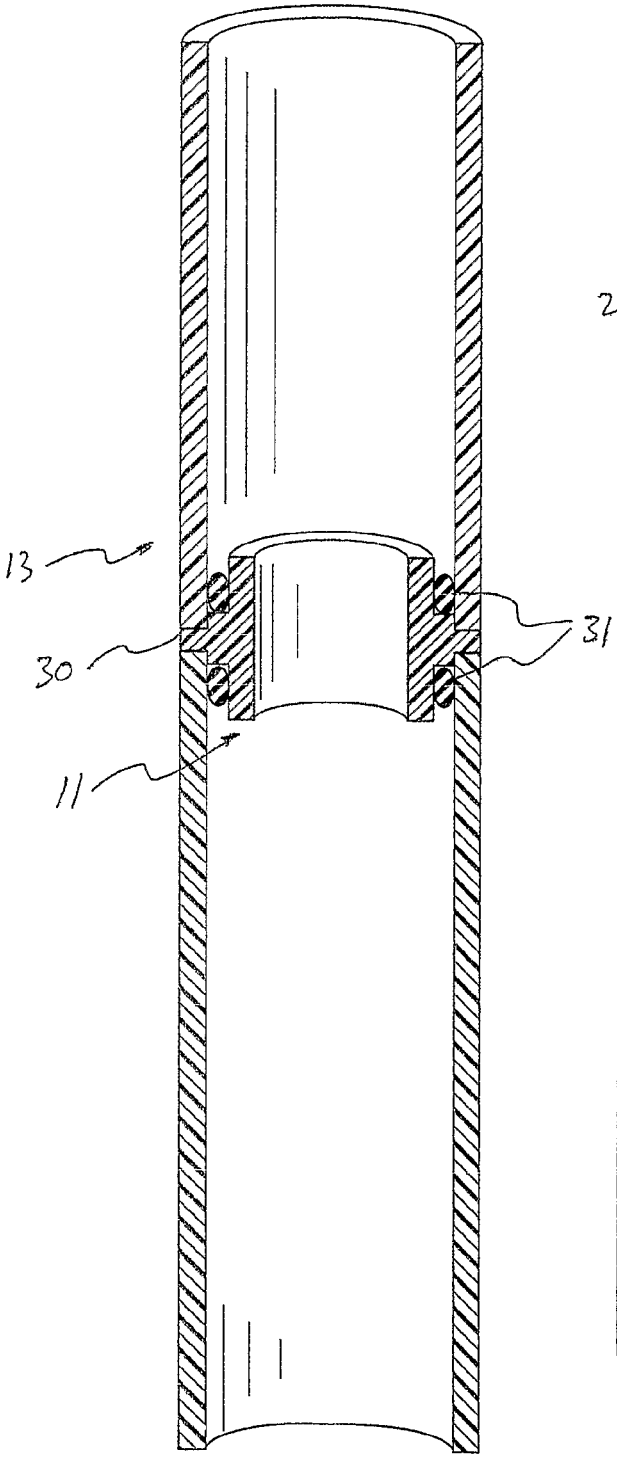
FIG. 18 is a cross-sectional view of one embodiment of the assembly depicting a constructive element serving as both an engaging member and a coupling member between two elongate members.

In yet another embodiment, the engaging member 11 may include a flange 30 formed about its circumference as illustrated in FIG. 18. In this fashion, a single engaging member 11 is used to secure two elongate members 13, 13A together. This embodiment provides a gasket 31 or O-ring for securing the engaging member 11 to the elongate members 13, 13A. Any sufficient adhesive substance may be used to further secure the gasket 31.

As assembled, the internal surfaces 20 of the first and second engaging members 11, 11A correspondingly engage the external surface 23 of the first coupling member 12 to secure the first engaging member 11 to the second engaging member 11A. In one embodiment, at least one internal surface 20 of the engaging member 11 is threaded. In similar fashion, the external surface 23 of the first coupling member 12 may be threaded. It will be understood, however, that corresponding engagement between the internal surfaces 20 of the first and second engaging members 11, 11A and the external surface 23 of the first coupling member 12 may be accomplished by slots, ribs, or similar fasteners.

In another embodiment, a plurality of other coupling members 12 are provided, wherein other coupling members 12 include an internal surface 22 and an external surface 23 and define a plurality of internal channels 15. A plurality of other engaging members may also be provided that likewise define a geometric shape and a plurality of internal channels 14. The other engaging members 11 having an internal surface 20 and an external surface 21. In this assembly 10, the plurality of other coupling members 12 connects the plurality of other engaging members to the first or second engaging members 11, 11A.

The assembly 10 also provides a first elongate member 13 defining an internal cavity 32 and a cross-section, and having an internal surface 34, a first end 35, and a second end 35A. At least one end 35 of the first elongate member 13 is open for receiving the first engaging member 11. The internal surface 34 of the first elongate member 13 correspondingly engages the external surface 21 of the first engaging member 11 when the open end 35 of the elongate member 13 receives the engaging members to secure the first elongate member 13 to the first engaging member 11. Each of the internal channels 14 of the first and second engaging members 11, 11A and the internal channel 15 of the first coupling member 12 are in communication with the internal cavity 32 of said first elongate member 13 to facilitate movement of any components previously described (e.g., vapor components, gaseous components, etc.).

The assembly 10 may further provide a second elongate member 13A defining an internal cavity 32 and a cross-section 33, and having an internal surface 34, a first end 35, and a second end 35. At least one end 35 of the second elongate member 13A is open for receiving the second engaging member 11A.

The cross-section 33 of the first and second elongate members 13, 13A may be in the shape of a square, a rectangle, a trapezoid, a circle, an oval, a triangle, a pentagon, a hexagon, a heptagon, an octagon, and combinations thereof.

The first and second elongate members 13, 13A form a variety of constructive elements to include a roofing element, a foundation element, a partition element, a wall element, and combinations thereof.

The first and second engaging members 11, 11A, the first coupling member 12, and the first and second elongate members 13, 13A are made from a variety of material to include wood, concrete, brick, tile, metal, fiberglass, particleboard, flakeboard, plywood, insulation board, fiberglass, cellulose, sawdust, natural fibers, mineral fibers, drywall, plaster, stucco, and combinations thereof.

FIGS. 1 through 12 provide depictions of a number of embodiments of the components of the assembly 10, which are representative of the various possible configurations for the assembly 10. These representations are merely representative and are not intended to disclose all possible embodiments.

Figure 2:
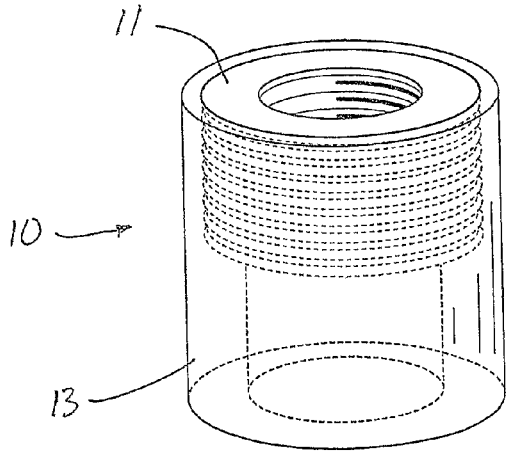
FIG. 2 is a perspective view of one embodiment of the assembly depicting an assembled view of an engaging member and an elongate member each having a circular cross-section.

FIG. 1 shows an engaging member 11 having a circular cross-section, a threaded external surface 21, and a longitudinal channel 14 having a threaded internal surface 20. This engaging member 11 corresponds with an elongate member 13 having a circular cross-section 33 and an internal cavity 32 having a threaded internal surface 34. The threaded internal surface 34 of the elongate member 13 and the threaded external surface 21 of the engaging member 11 correspondingly engage to join the elements. FIG. 2 shows the union of these elements depicted in this embodiment of the assembly 10.

Figure 3:
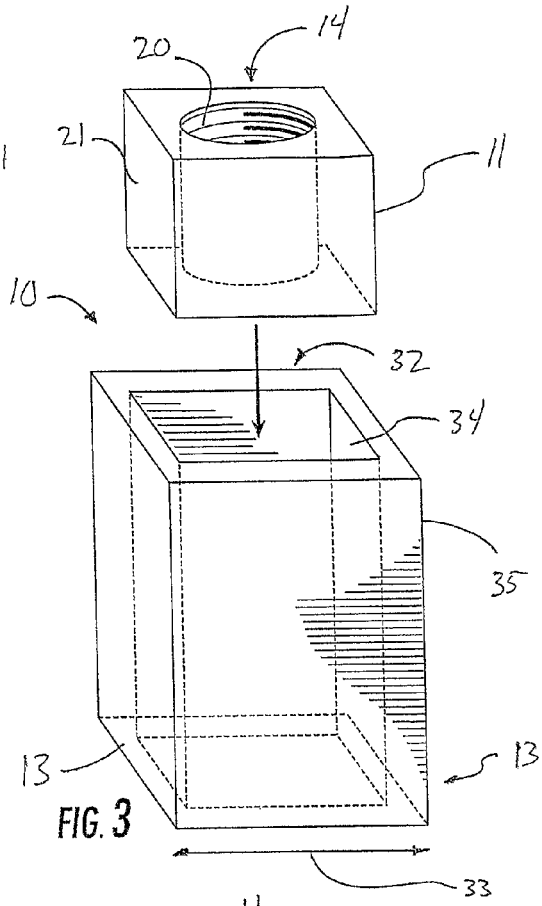
FIG. 3 is a perspective view of one embodiment of the assembly depicting an exploded view of an engaging member and an elongate member each having a square cross-section.
Figure 4:
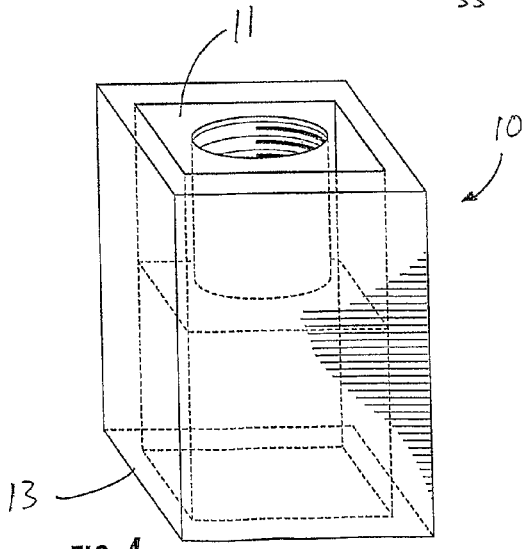
FIG. 4 is a perspective view of one embodiment of the assembly depicting an assembled view of an engaging member and an elongate member each having a square cross-section.

FIG. 3 shows another embodiment of an engaging member 11 having a square cross-section, a smooth external surface 21, and a longitudinal channel 14 having a threaded internal surface 20. This engaging member 11 corresponds with an elongate member 13 having a square cross-section 33 and an internal cavity 32 having a smooth internal surface 34. The internal surface 34 of the elongate member 13 and the external surface 21 of the engaging member 11 correspondingly engage to join the elements. In this embodiment, the joining of the elements may include the use of a ceramic, polymeric, or cementations adhesive or other bonding agent. FIG. 4 shows the union of these elements depicted in this embodiment of the assembly 10.

Figure 5:
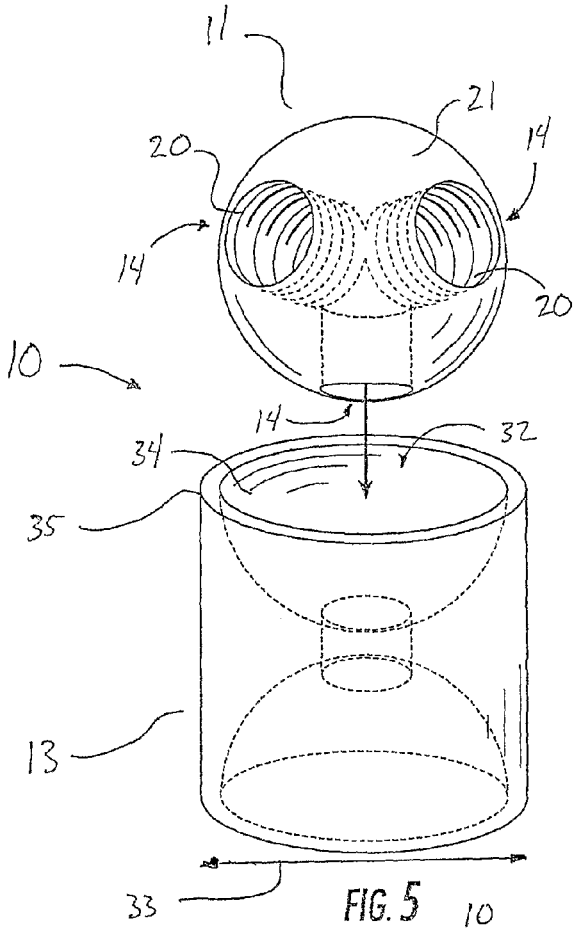
FIG. 5 is a perspective view of one embodiment of the assembly depicting an exploded view of a spherical engaging member and an elongate member having a circular cross-section.

FIG. 5 shows another embodiment of an engaging member 11 having a spherical design, a smooth external surface 21, and more than one channel 14 having threaded internal surfaces 20. This engaging member 11 corresponds with an elongate member 13 having a circular cross-section 33, an internal cavity 32, and spherical opening having a smooth internal surface 20. The internal surface 34 of the elongate member 13 and the external surface 21 of the engaging member 11 correspondingly engage to join the elements. In this embodiment, the joining of the elements may again include the use of a ceramic, polymeric, or cementations adhesive or other bonding agent.

Figure 6:
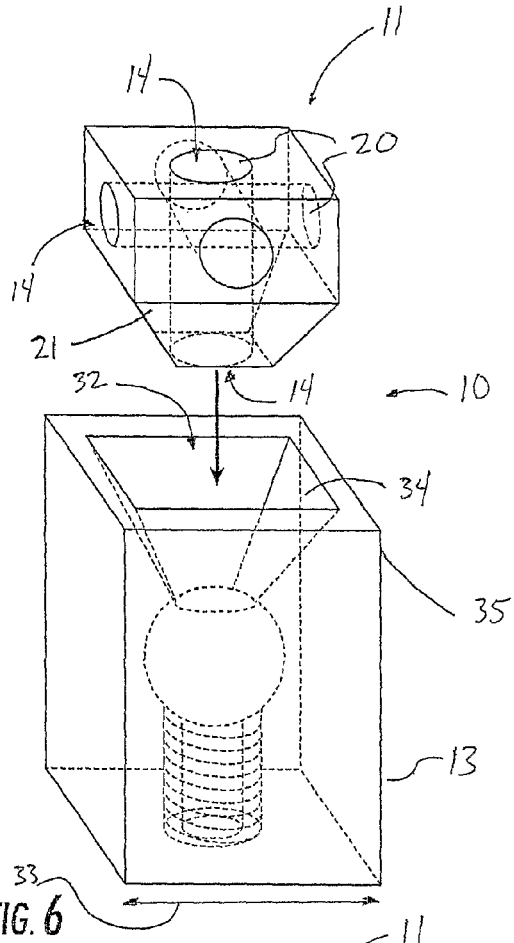
FIG. 6 is a perspective view of one embodiment of the assembly depicting an exploded view of a multi-faceted engaging member and an elongate member having a square cross-section.

FIG. 6 shows another embodiment of an engaging member 11 having a multi-faceted shape, a smooth external surface 21, and more than one channel 14. This engaging member 11 corresponds to an elongate member 13 having a square cross-section 33, an internal cavity 32, and pyramidal opening having a smooth internal surface 34. The internal surface 34 of the elongate member 13 and the external surface 21 of the engaging member 11 correspondingly engage to join the elements. In this embodiment, the joining of the elements may again include the use of a ceramic, polymeric, or cementations adhesive or other bonding agent.

Figure 7:
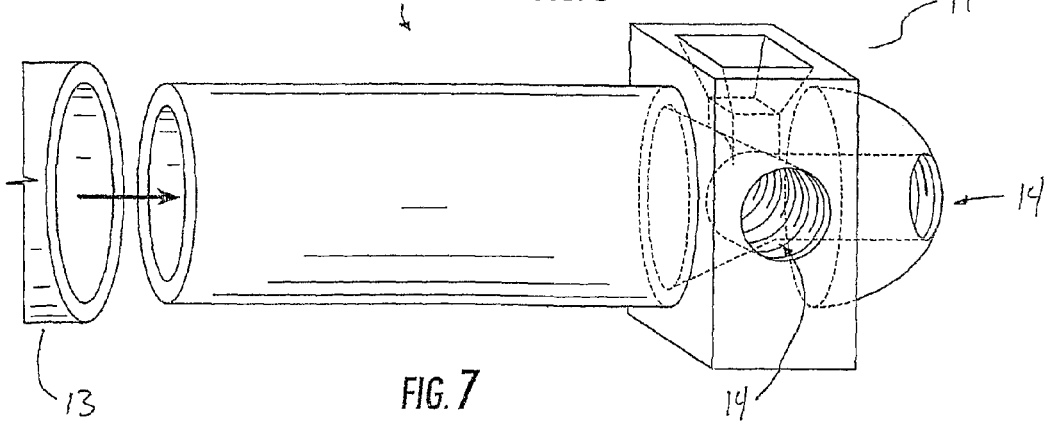
FIG. 7 is a perspective view of one embodiment of the assembly depicting an assembled view of a combination engaging member and an elongate member having a circular cross-section.

FIG. 7 shows another embodiment of an engaging member 11 having a combination of geometric shapes, a smooth external surface 21, and more than one channel 14. The combination of geometric forms on the engaging member 11 may correspond to a variety of elongate members 13.

Figure 9:
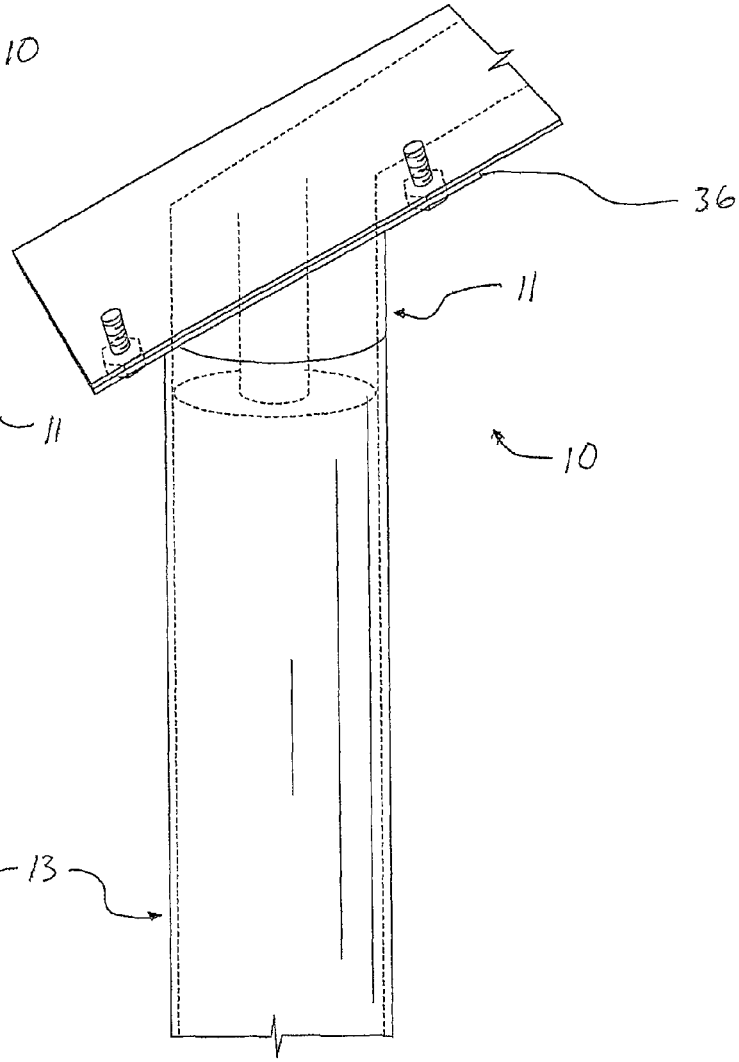
FIG. 9 is a perspective view of one embodiment of the assembly depicting an assembled view of an angled engaging member, an elongate member having a circular cross-section, and a plate facilitating connection to other constructive elements.

FIG. 8 shows another embodiment of an engaging member 11 having one beveled end, one flat end, a circular cross-section, and a threaded internal surface 20 along a longitudinal channel 14. This engaging member 11 corresponds with an elongate member 13 likewise having a circular cross-section 33. The elongate member 13 and the engaging member 11 correspondingly engage to join the elements. FIG. 9 shows that the beveled end of this embodiment of the engaging member 11 may then be further engaged to other elements such as a plate 36 to facilitate engagement of another elongate member 13. The plate 36 may allow for bonding, welding, bolting, expansion, or contraction anchoring.

Figure 10:
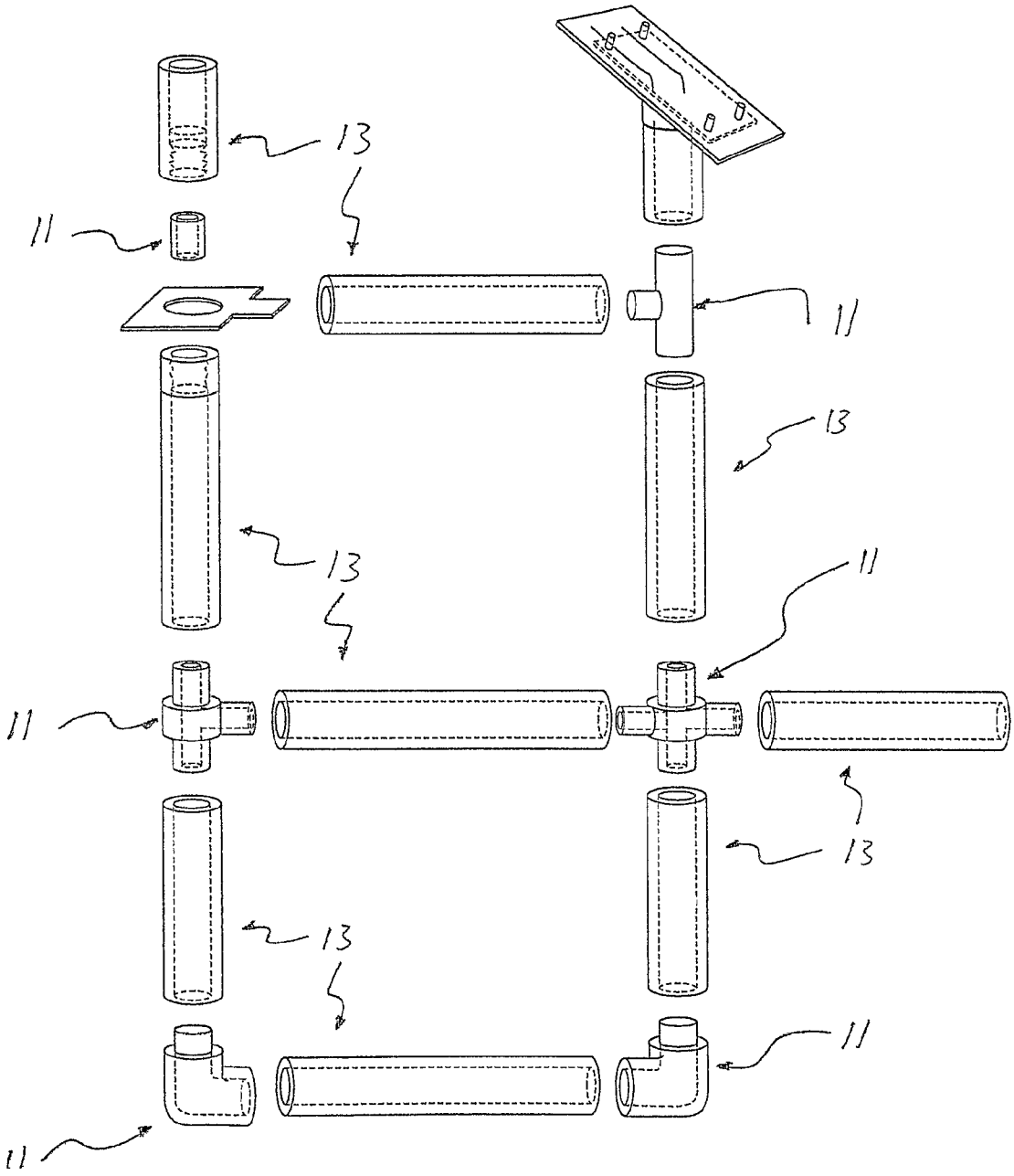
FIG. 10 is a perspective view of various embodiments of the assembly depicting an exploded view of engaging members and elongate members in a variety of configurations.

FIG. 10 shows a series of embodiments of elongate members 13 and engaging members 11. The figure shows that the engaging members 11 may not only be constructed in a variety of geometric forms but may also be constructed in a variety of directional configurations, such as an angle, a T-connection, or a 4-way connection, among others.

Figure 11:
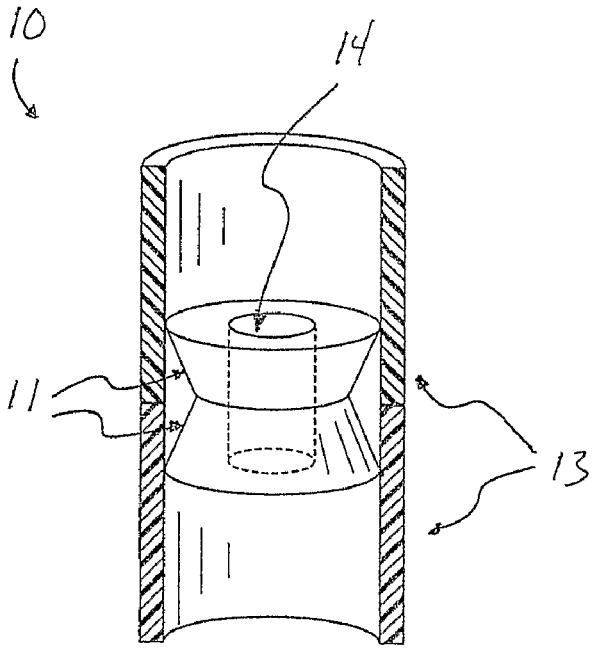
FIG. 11 is a cross-sectional view of one embodiment of assembly depicting two engaging members assembled within two adjacent elongate members.
Figure 12:
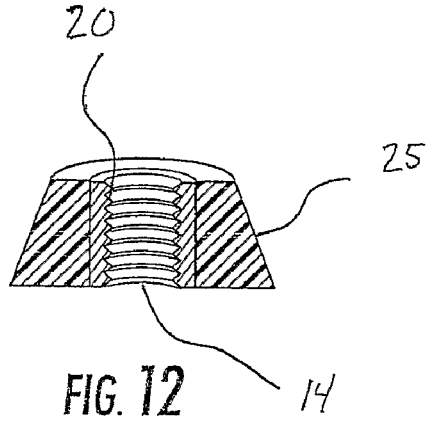
FIG. 12 is a cross-sectional view of one embodiment of assembly depicting an engaging member having a threaded internal surface.

FIG. 11 depicts a cross-section of two engaging members 11 serving to join two elongate members 13. The engaging members 11 in this embodiment have a tapered external surface 21. FIG. 12 shows a cross-section of such an engaging member 11 having a tapered external surface 21 and a threaded internal surface 20.

FIGS. 13 through 23 provide additional depictions of a number of embodiments of the components of the assembly 10. FIG. 13 shows two engaging members 11, 11A being joined by a coupling member 12. In this embodiment, one of the two engaging members 11A has a threaded internal surface 20 while the other engaging member 11 has a smooth internal surface 20. The coupling member 12 passes through the smooth internal surface 20 of one engaging member 11 and has a threaded external surface 23 serving to correspondingly engage the threaded internal surface 20 of the second engaging member 11A. The coupling member 12 also has an internal channel 15 serving to allow the flow of gases, vapors, liquids, particulates, plasma, photons, electromagnetic fields, electric fields, or any other matter or energy among elongate member 13s joined by the assembly 10.

Figure 15:
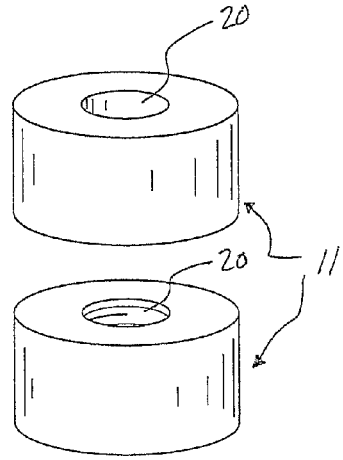
FIG. 15 is a perspective view of one embodiment of the assembly depicting an exploded view of two engaging member.

FIG. 14 shows an assembled view of the two engaging members 11, 11A and the coupling member 12 of this embodiment, along with two corresponding elongate members 13, 13A. The arrows show that the internal channel 15 of the coupling member 12 allows flow of material or energy between the two joined elongate members 13, 13A. FIG. 15 shows another depiction of the two engaging members 11, 11A described in this embodiment.

Figure 16:
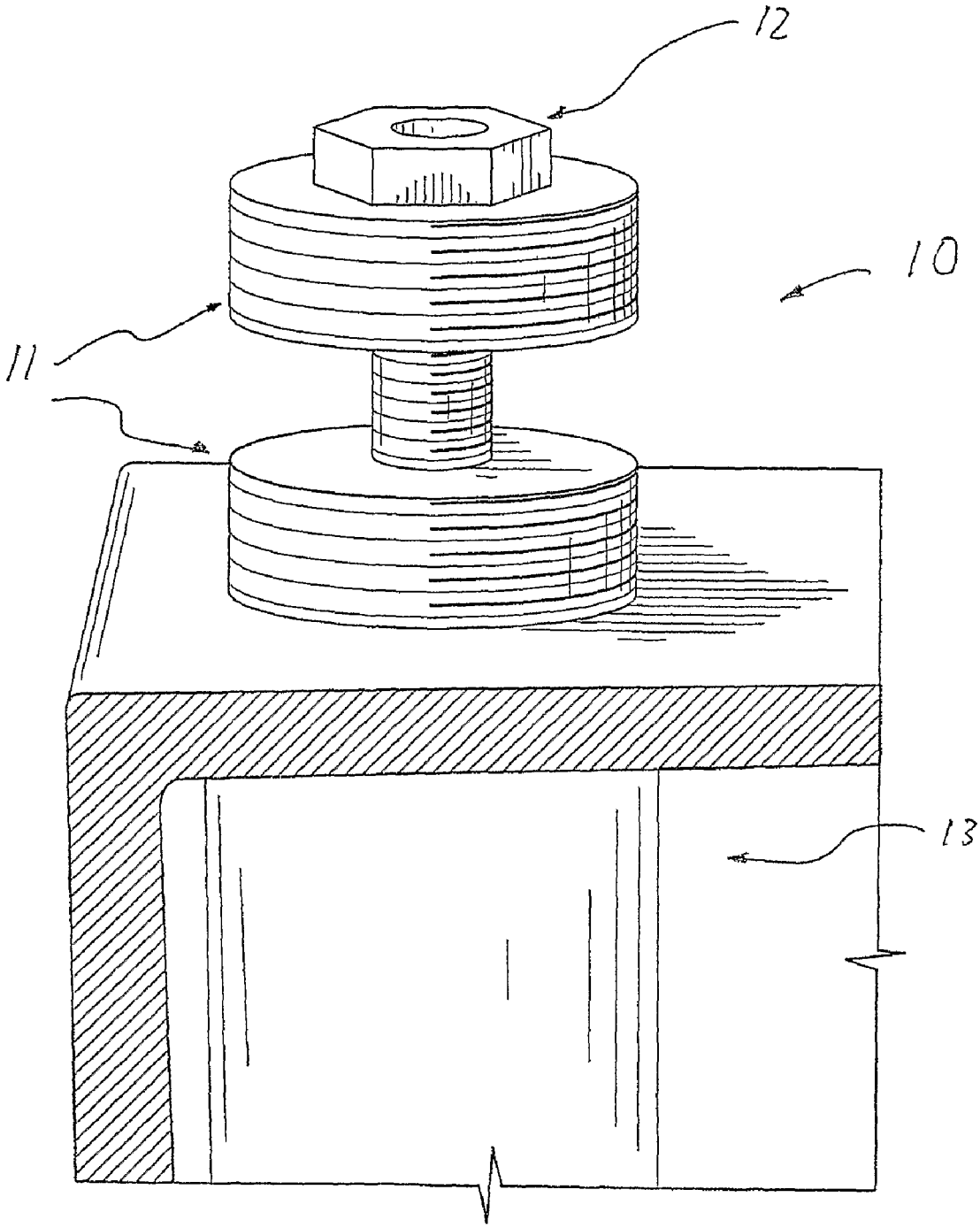
FIG. 16 is a perspective view of one embodiment of the assembly depicting a partially assembled view of two engaging members, a corresponding coupling member, and one other constructive element.
Figure 17:
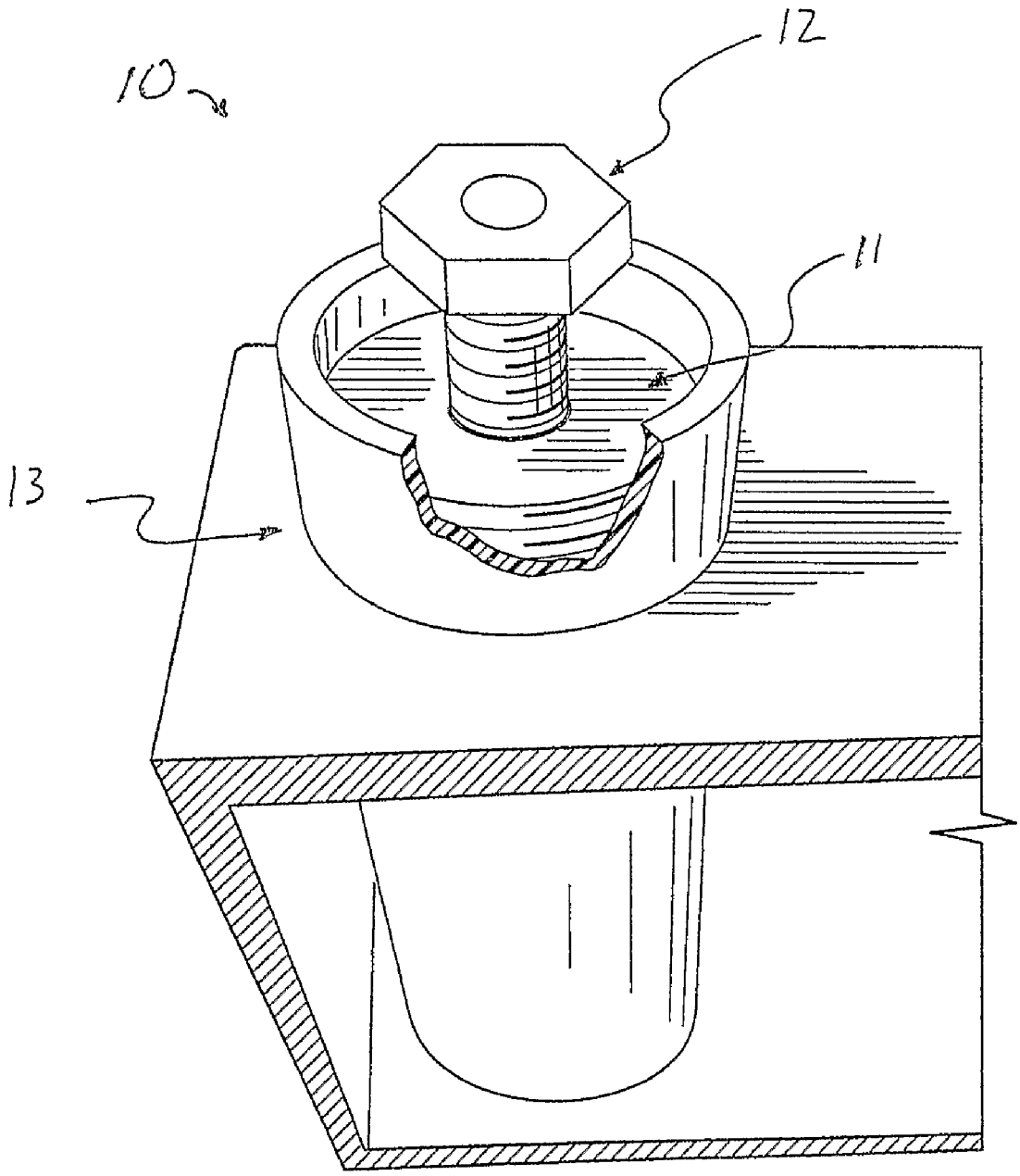
FIG. 17 is a perspective view of one embodiment of the assembly depicting a partially assembled view of two engaging members, a corresponding coupling member, and one other constructive element.

FIG. 16 depicts a partially assembled view of another embodiment of two engaging members 11, 11A, a corresponding coupling member 12, and an elongate member 13. The engaging members 11, 11A each have a threaded external surface 21 serving to join the engaging members 11, 11A to corresponding elongate members 13, 13A. FIG. 17 provides another view of a similar assembly 10 having an engaging member 11 engaged with an elongate member 13 and a coupling member 12.

FIG. 18 shows an engaging member 11 joining two elongate members 13, 13A. In this embodiment, only one engaging member 11 is needed to join the elongate members 13, 13A, and a pair of gaskets 31 or other bonding agents serve as coupling members 12.

Figure 19:
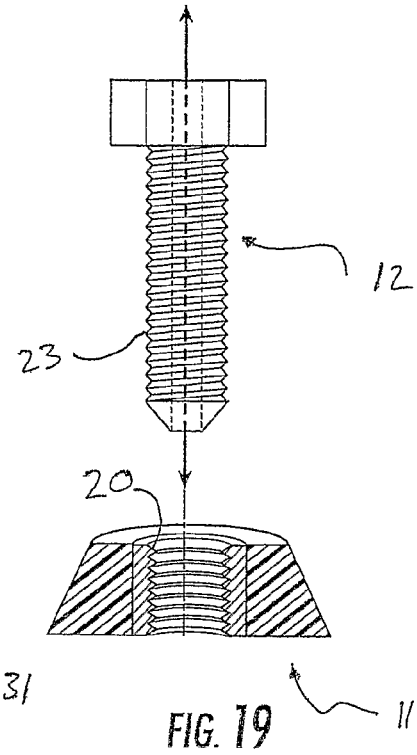
FIG. 19 is a cross-sectional view of one embodiment of the assembly depicting an exploded view of an engaging member and a corresponding coupling member.
Figure 20:
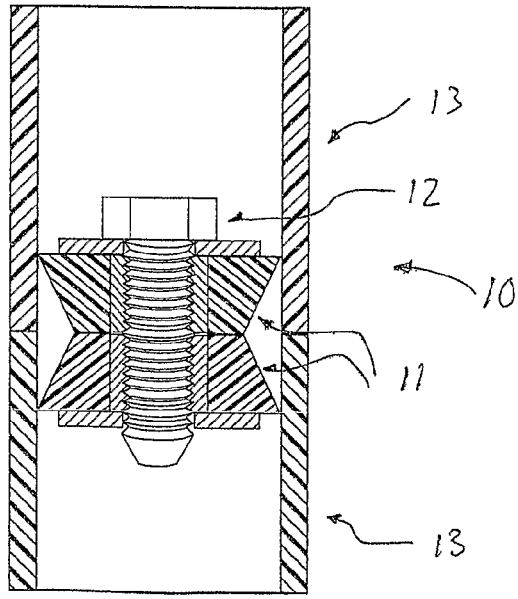
FIG. 20 is a cross-sectional view of one embodiment of the assembly depicting an assembled view of two engaging members, two elongate members, and a corresponding coupling member.

FIG. 19 is a cross-sectional view of one embodiment of the assembly 10 depicting an engaging member 11 having a tapered external surface 21 and a channel 14 having a threaded internal surface 20. Also depicted is a corresponding coupling member 12 having a threaded external surface 23 corresponding to threaded internal surface 20 of the engaging member 11. FIG. 20 shows a cross-sectional view of this embodiment of the assembly 10 joining the engaging member 11 and coupling member 12 with an additional engaging member 11 and two elongate members 13, 13A.

Figure 21:
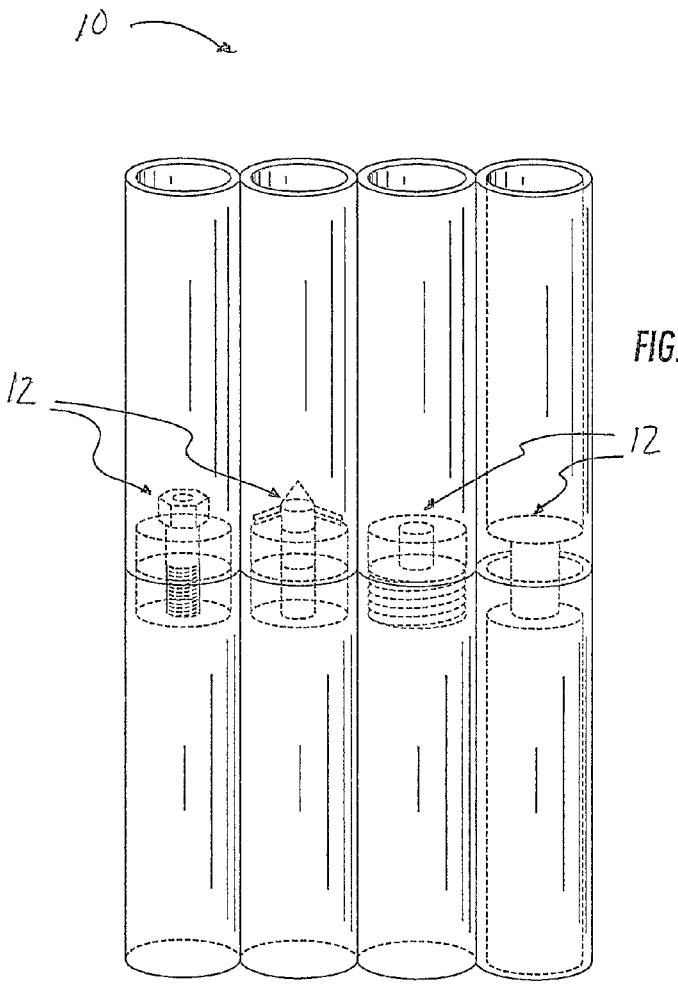
FIG. 21 is a perspective view of various embodiments of the assembly depicting an assembled view of engaging members, elongate members, and four different kinds of coupling members.

A variety of embodiments of a coupling member 12 for the assembly 10 are shown in FIG. 21. This figure shows that the coupling member 12 may take the form of a bolt, a sleeve and pin, male and female threaded elements, bonding tube ends, or bonding plugs or fittings.

Figure 22:
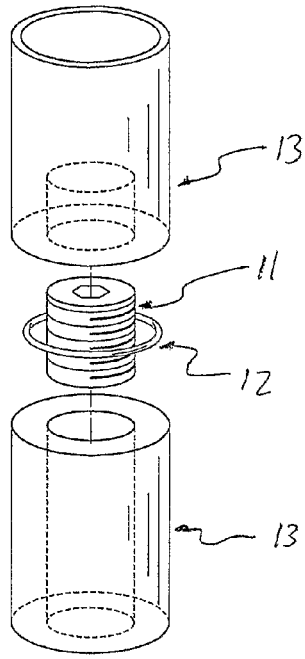
FIG. 22 is a perspective view of one embodiment of the assembly depicting an exploded view of an engaging member, elongate members, and a coupling member.
Figure 23:
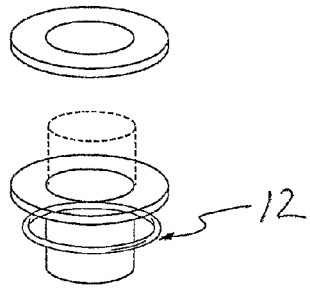
FIG. 23 is a perspective view of one embodiment of the assembly depicting an exploded view of an engaging member and a coupling member.

FIG. 22 shows another embodiment of a coupling member 12 joining an engaging member 11 and two elongate members 13, 13A. In this embodiment, the coupling member 12 may be a gasket 31, a layer of adhesive, or some other bonding material known in the art. FIG. 23 shows another variation of this embodiment, where the coupling member 12 comprises a washer and a gasket 31, a layer of adhesive, or some other bonding material.

In another aspect, the invention is a manifold assembly 40 for construction comprising a manifold 41 defining an internal cavity 42, one or more ports 43, and a geometric shape. The manifold 41 includes one or more conduits 44 extending internally of the manifold 41 and in communication with the ports 43, wherein the ports define a cross-section.

The manifold assembly 40 also provides a first engaging member 11 secured to one of the ports 43 of the manifold 41. The first engaging member 11 defines a geometric shape and at least one internal channel 14, and includes an internal surface 20 and an external surface 21.

A first elongate member 13 is secured to the first engaging member 11. The first elongate member 13 defines an internal cavity 32 and a cross-section 33, and includes an internal surface 34, a first end 35, and a second end 35A. One end 35 of said first elongate member 13 is open for receiving the first engaging member 11.

The internal surface 34 of the first elongate member 13 correspondingly engages the external surface 21 of the first engaging member 11 to secure the first elongate member 13 to the first engaging member 11 and the manifold 41.

The cross-section of the ports 43 may be in the shape of a square, a rectangle, a trapezoid, a circle, an oval, a triangle, a pentagon, a hexagon, a heptagon, an octagon, and combinations thereof.

A second engaging member 11A may be secured to another port of the manifold 41. The second engaging member 11A defines a geometric shape and at least one internal channel 14, and includes an internal surface 20 and an external surface 21.

A second elongate member 13A may be secured to the second engaging member 11A. The second elongate member 13A defines an internal cavity 32 and a cross section, and includes an internal surface 34, a first end 35, and a second end 35A. One end 35 of the second elongate member 13A is open for receiving the second engaging member 11A.

The internal surface of the second elongate member 13A correspondingly engages the external surface 21 of the second engaging member 11A to secure the second elongate member 13A to the second engaging member 11A and the manifold 41.

The geometric shape of the manifold 41 and the first and second engaging members 11, 11A may be in the form of a sphere, a square, a cube, a rectangle, a trapezoid, a circle, a cone, an oval, a triangle, a pentagon, a hexagon, a heptagon, an octagon, and combinations thereof.

The internal channels 14 of the first and second engaging members 11, 11A and the internal cavities of the first and second elongate members 13, 13A are in communication with the conduits 44 of the manifold 41.

Figure 24:
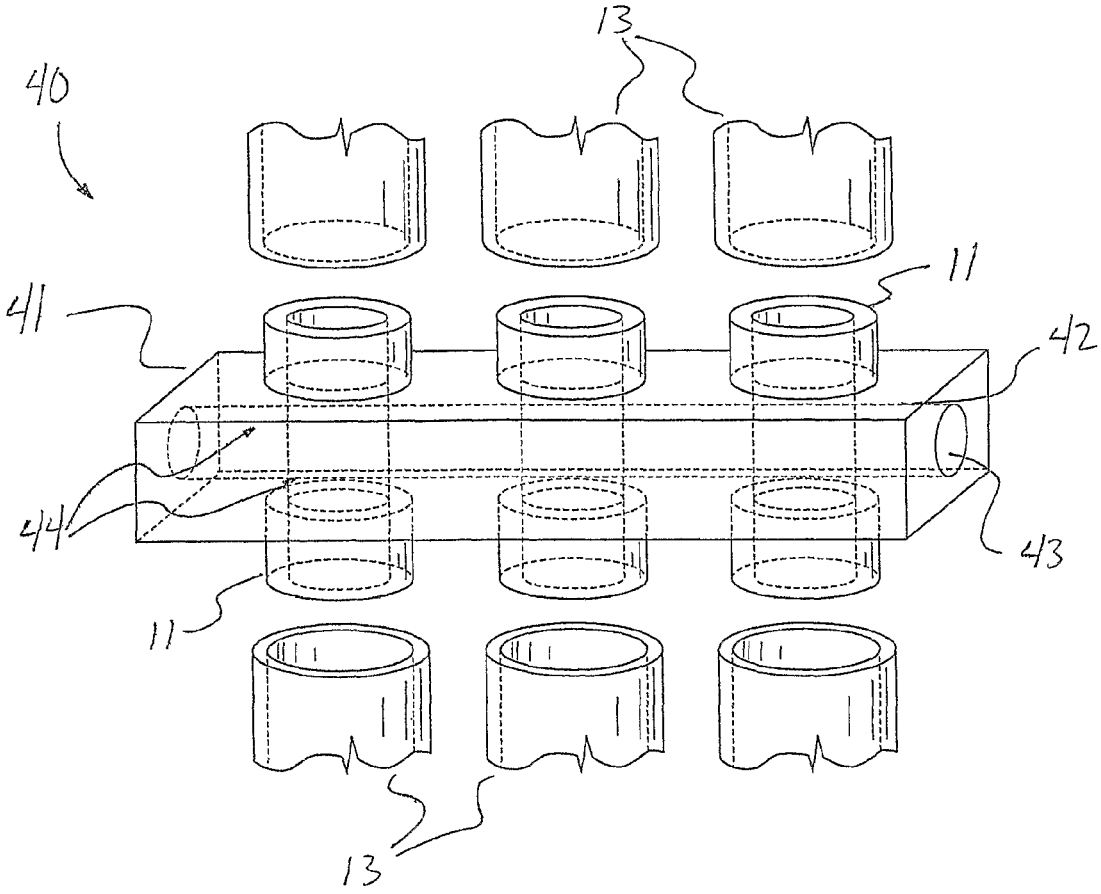
FIG. 24 is a perspective view of one embodiment of the manifold assembly depicting an exploded view of a manifold, engaging members, and elongate members.

FIG. 24 depicts one embodiment of the manifold assembly 40. The figure shows a manifold 41 having an internal cavity 42 and a number of conduits 44 serving to allow communication between connected elongate members 13. The elongate members 13 are joined to the manifold 41 by the use of engaging members 11 at various ports 43 on the manifold.

Figure 25:
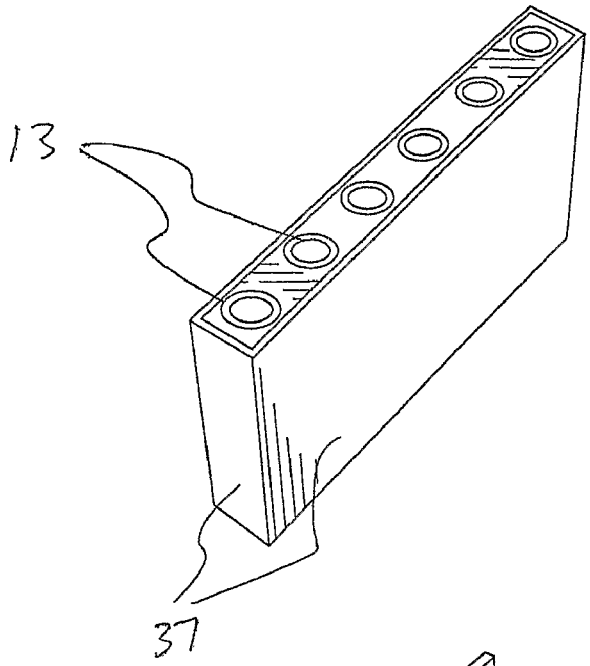
FIG. 25 is a perspective view of one embodiment of the manifold assembly depicting an assembled view of a variety of panels surrounding an array of elongate members.
Figure 26:
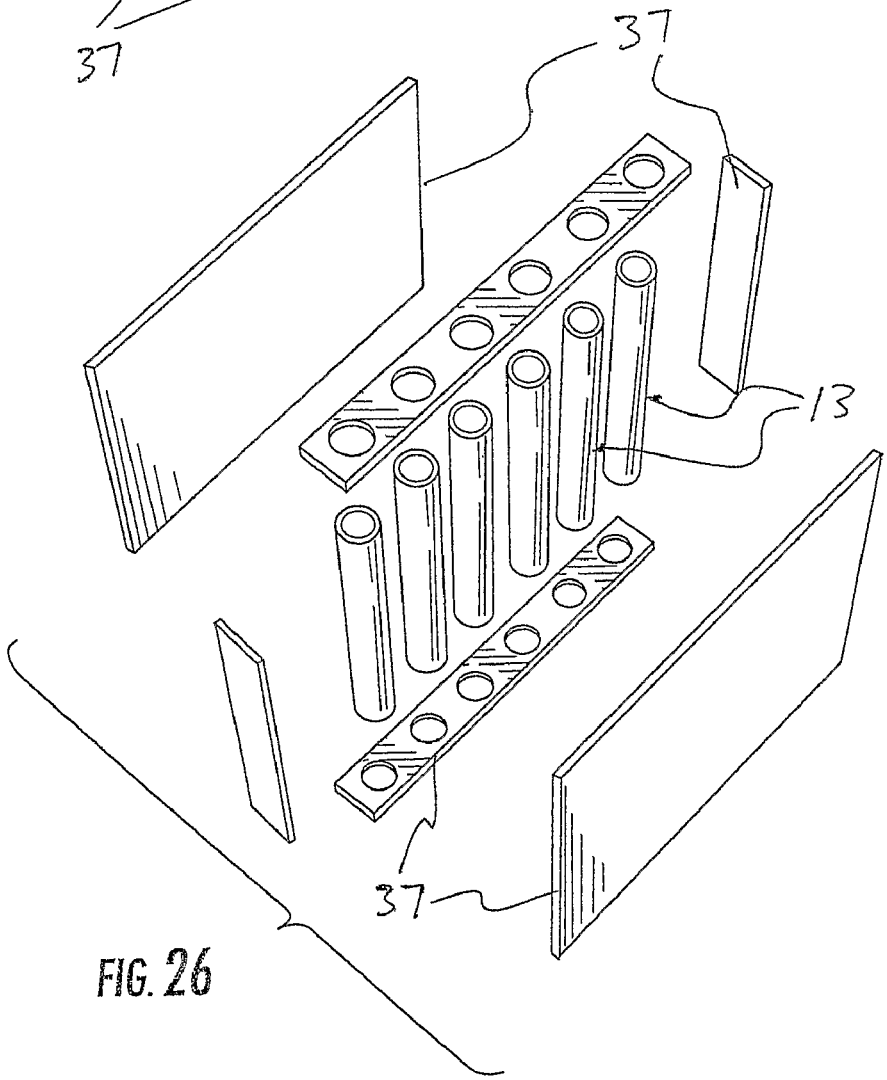
FIG. 26 is a perspective view of one embodiment of the manifold assembly depicting an exploded view of a variety of panels surrounding an array of elongate members.

FIG. 25 shows a combination of elongate members 13 and panels 37 to be used with the manifold assembly 40. The panels 37 surround the elongate members 13, serving to protect the elongate members 13 from external environmental stress. FIG. 26 shows an exploded view of this embodiment further detailing the relationship between the elements.

Figure 27:
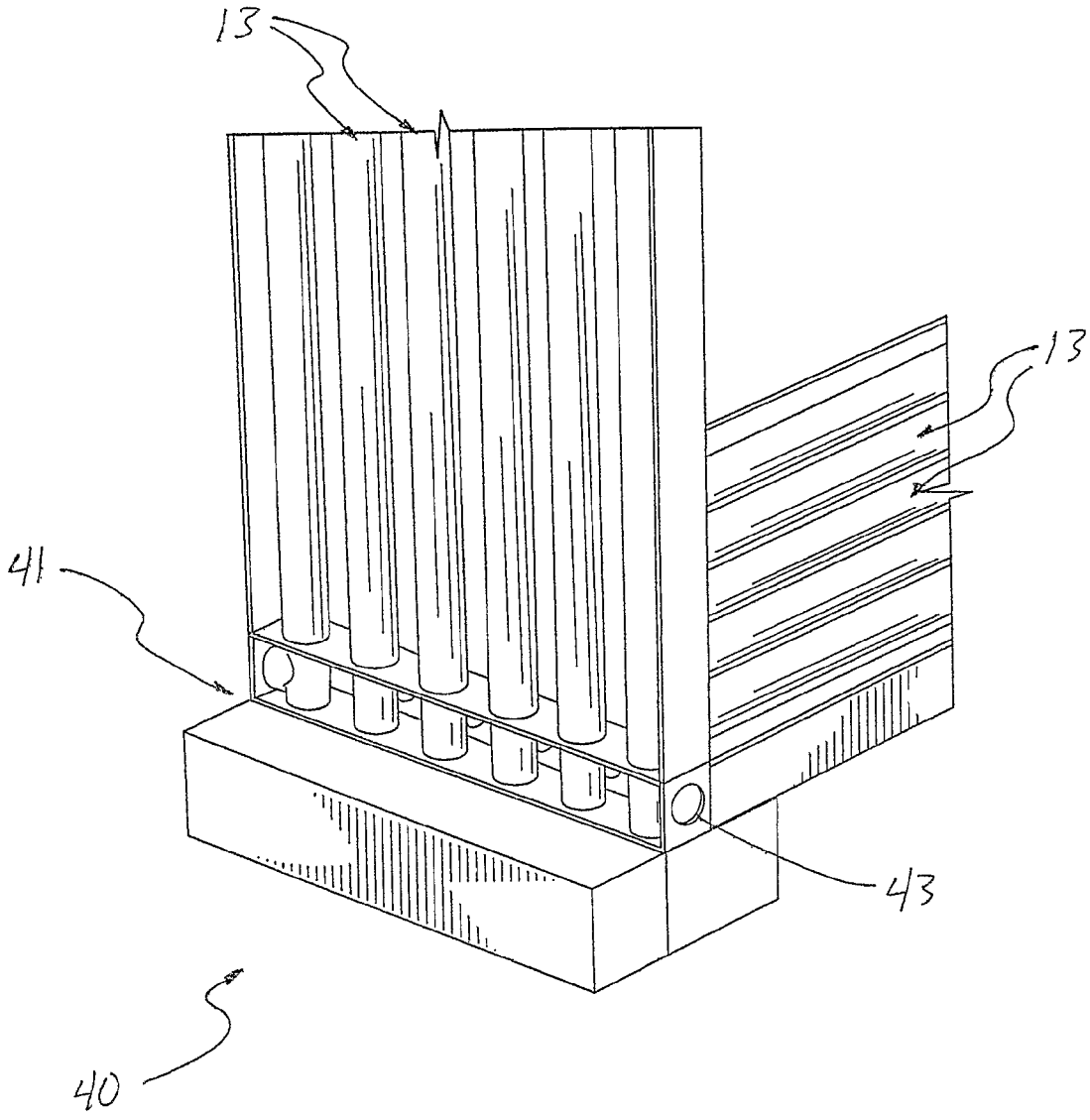
FIG. 27 is a perspective view of one embodiment of the manifold assembly depicting a manifold and a number of connected elongate members.

FIG. 27 shows an embodiment of the manifold assembly 40. In this embodiment, arrays of elongate members 13 are connected to the manifold 41 in two directions. A port on the manifold 41 allows for connections of other manifold assemblies. This embodiment may serve as the connection between a wall and a floor of a structure.

Figure 28:
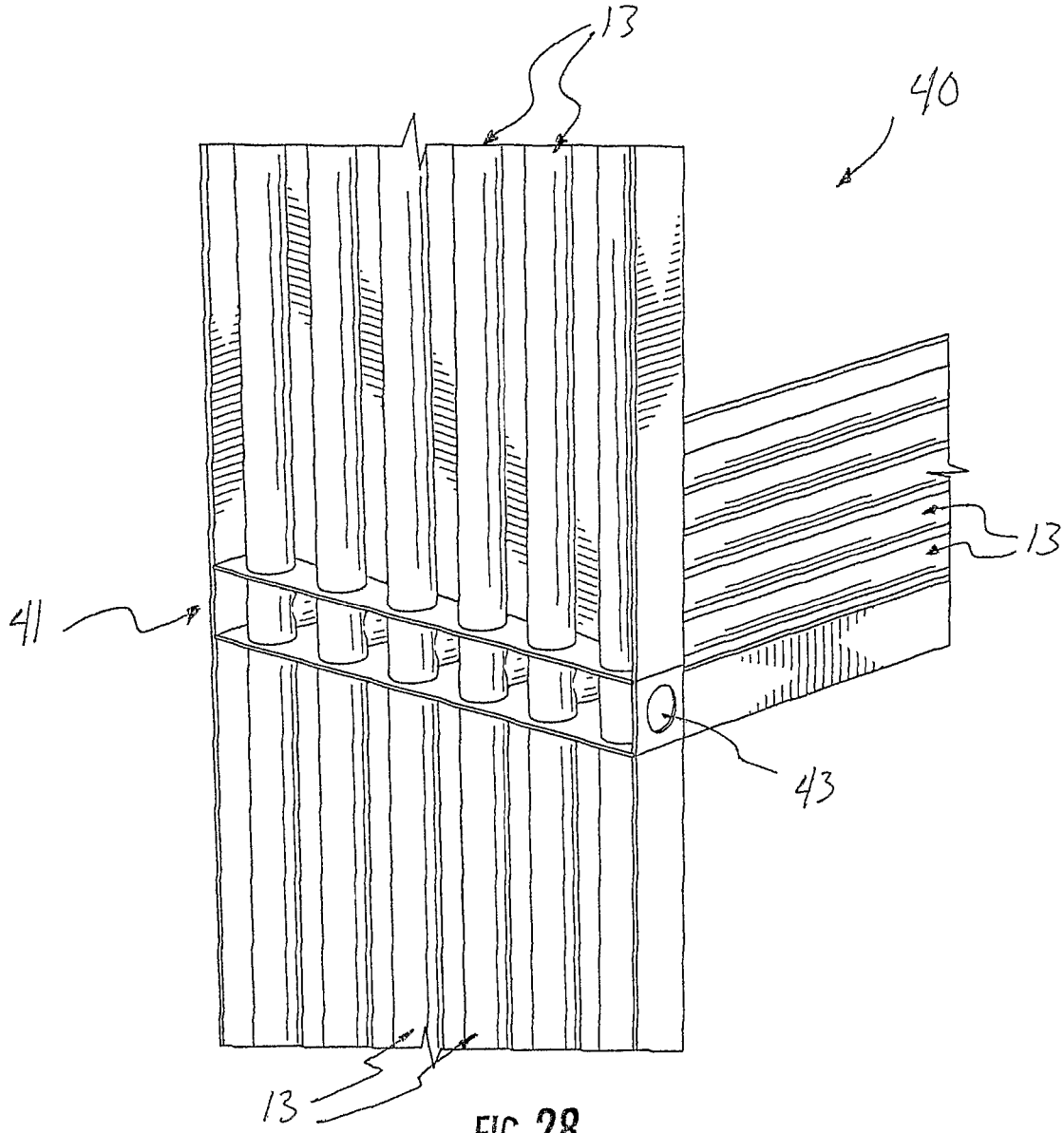
FIG. 28 is a perspective view of one embodiment of the manifold assembly depicting a manifold and a number of connected elongate members.
Figure 29:
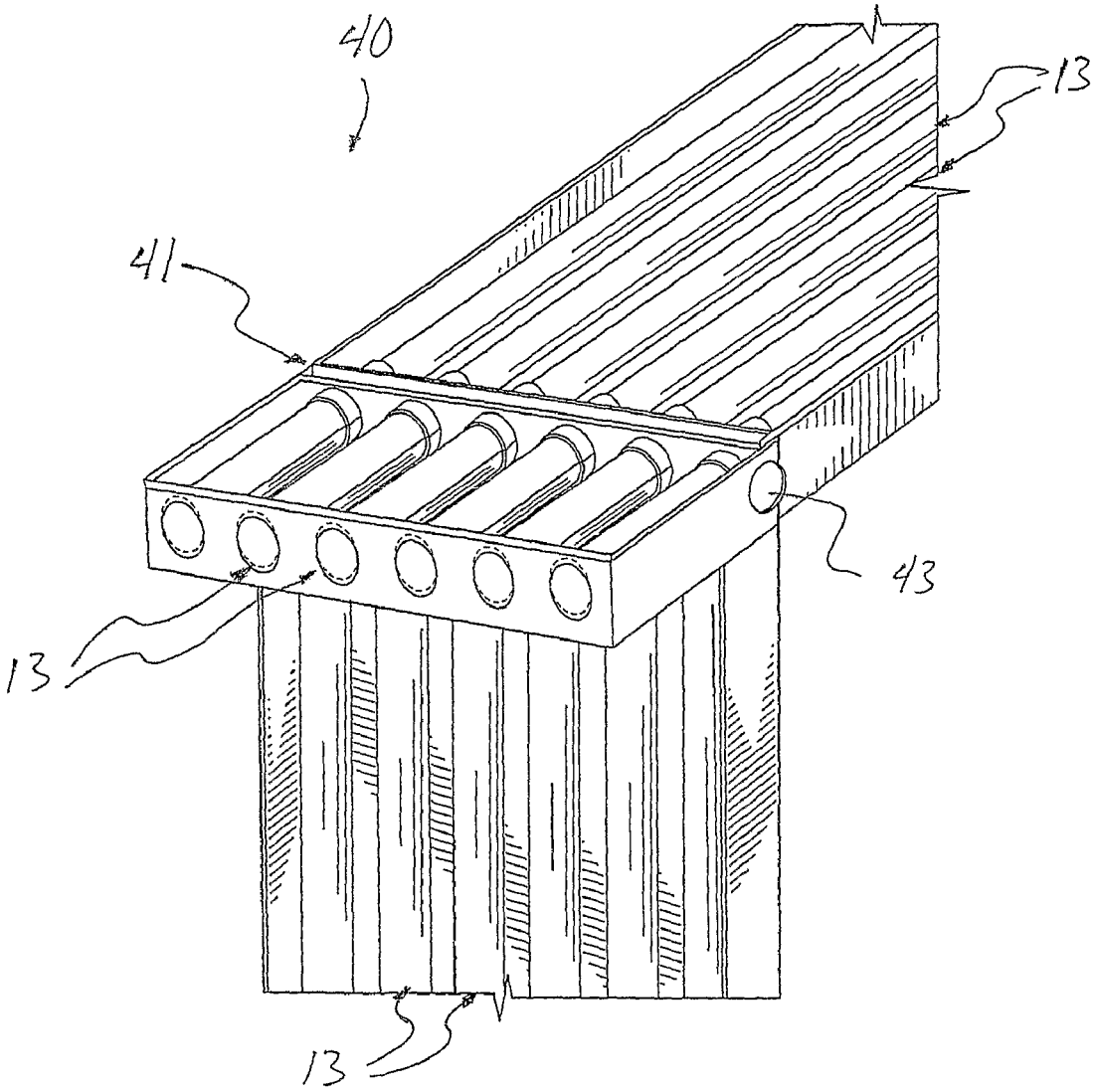
FIG. 29 is a perspective view of one embodiment of the manifold assembly depicting a manifold and a number of connected elongate members.

FIG. 28 shows a manifold assembly 40 joining arrays of elongate members 13 in three directions. Again, a port on the manifold 41 allows for connections of other manifold assemblies. FIG. 29 shows a variation on this embodiment of the manifold assembly 40 where the manifold 41 connects three arrays of elongate members 13.

Figure 30:
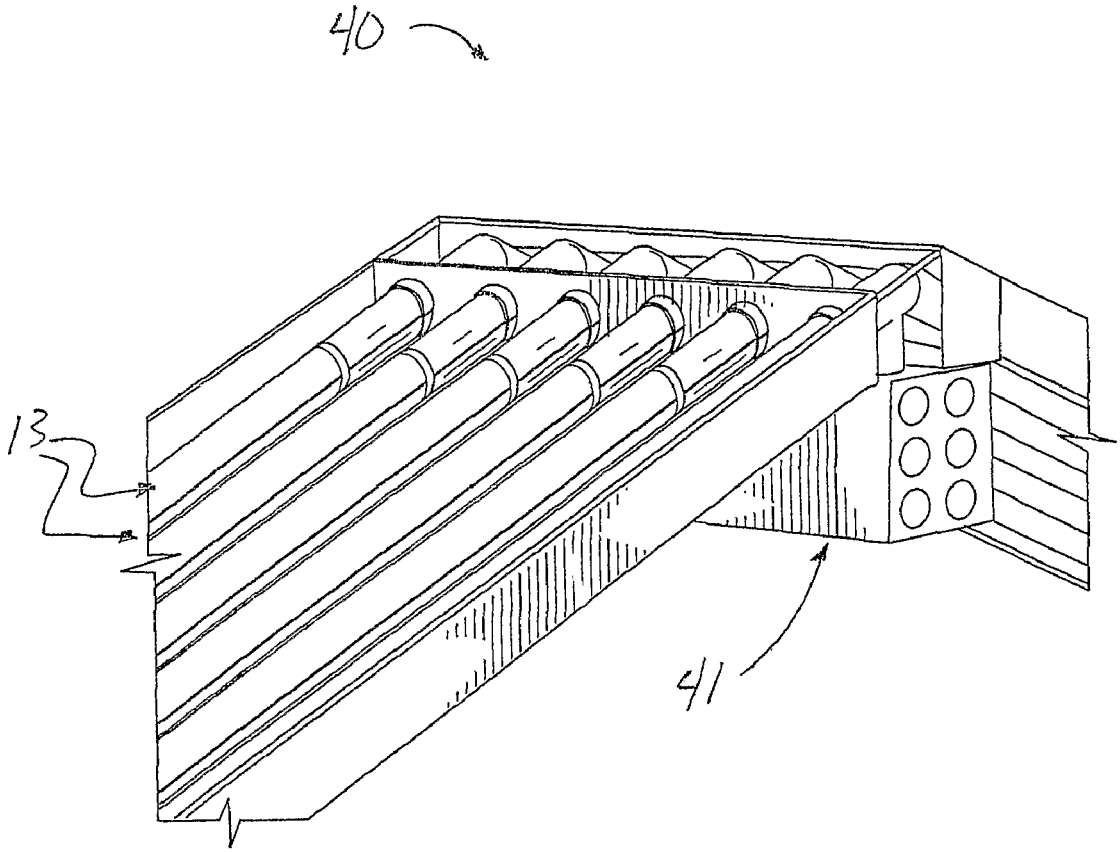
FIG. 30 is a perspective view of one embodiment of the manifold assembly depicting a manifold and a number of connected elongate members.

FIG. 30 shows another embodiment of the manifold assembly 40. In this embodiment, the manifold 41 joins two arrays of elongate members 13 meeting at a peak. This embodiment may be used to form a roof section of a structure.

In another aspect, the invention is a structural assembly 50 for use in construction. The structural assembly 50 provides one or more dynamic constructive elements 51 that define at least one cavity. The dynamic constructive elements 51 are capable of maintaining structural integrity under load bearing conditions. In other words, the dynamic constructive elements 51 are sufficient for use in constructing dwellings, house, hangars, garages, and buildings.

The structural assembly 50 also provides one or more manifolds 41 connected to the dynamic constructive elements 51. The manifolds 41 define at least one conduit 44.

The structural assembly 50 further provides one or more controllers for regulating the environment within the cavity of the dynamic constructive elements 51. The controller incorporates a variety of valves to direct the flow of various components throughout the structural assembly. In particular, a manifold 41 having a variety of controlling mechanisms (e.g., pneumatic valve, butterfly valve, disk valve, ball float valve, etc.) may serve as a controller. Advantageously, the cavities of the dynamic constructive elements 51, the conduits of the manifolds 41, and the controllers are in communication.

The structural assembly 50 also provides one or more connectors (e.g., gasket, adhesive layer, etc.) defining at least one channel, wherein the connectors secure the dynamic constructive elements 51 to the manifolds 41. As constructed, the cavities of the dynamic constructive elements 51, the conduits 44 of the manifolds 41, and the channels of the connectors communicate with one another to facilitate regulation of the environment within the cavity of the dynamic constructive elements 51. It will be understood that the dynamic constructive elements 51 may be comprised of one or more elongate members 13.

The controller regulates the environment within the cavities of the dynamic constructive elements 51 and the conduits of the manifolds 41 by controlling the flow of gases, vapors, liquids, particulates, plasma, photons, electromagnetic fields, electric fields, or any other matter or energy.

Figure 31:
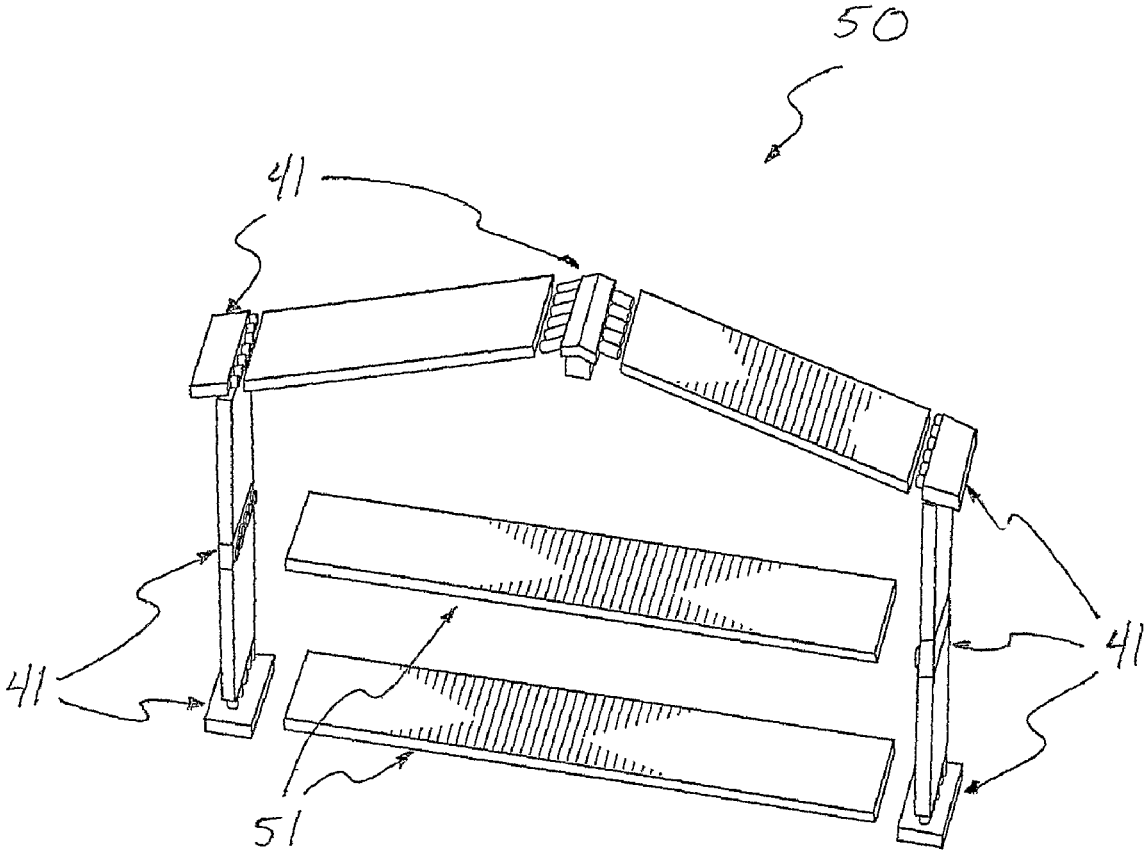
FIG. 31 is a perspective view of one embodiment of the structural assembly depicting an exploded view of an assembly of various manifolds and dynamic constructive elements.

FIG. 31 depicts a structural assembly 50 comprising a plurality of manifolds 41 and dynamic constructive elements 51. The dynamic constructive elements 51 may be constructed from an array of elongate members 13 surrounded by protective panels 37.

Figure 32:
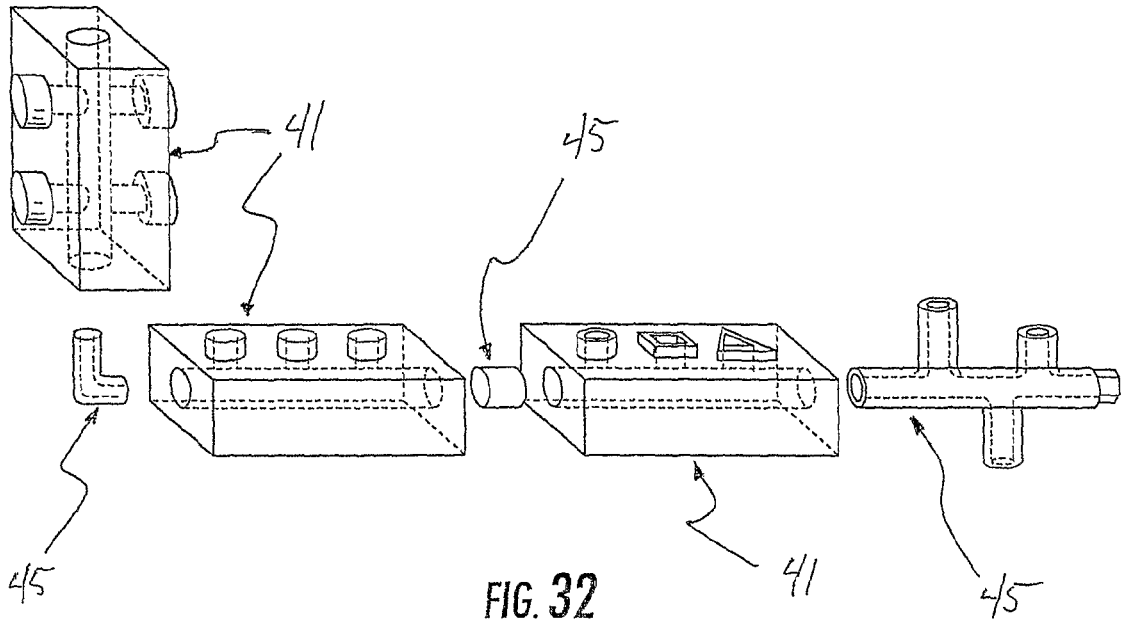
FIG. 32 is a perspective view of one embodiment of the manifold assembly depicting an exploded view of a variety of manifolds and various manifold coupling members.

FIG. 32 depicts a combination of manifold assemblies 40. The manifolds 41 are joined by manifold coupling members 45. The drawing shows that these manifold coupling members 45 may have various forms based on different applications: they may be angled, straight, or have combined features. This figure also shows a variety of engaging members 11 that may be used to connect manifolds 41 to other constructive elements.

Figure 33:
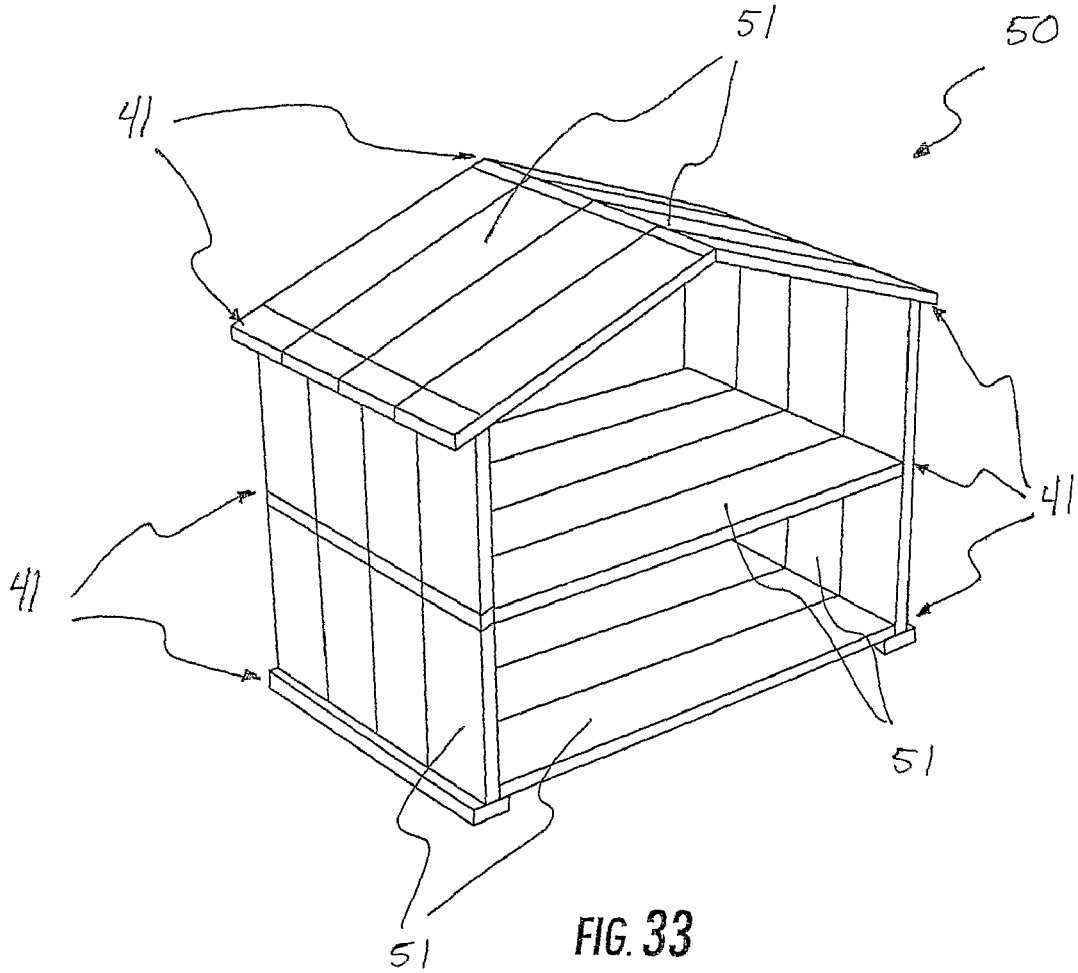
FIG. 33 is a perspective view of one embodiment of the structural assembly depicting an assembled view of an assembly of various manifolds and dynamic constructive elements.

FIG. 33 depicts an assembled structural assembly 50. The structural assembly 50 is comprised of a plurality of manifolds 41 and dynamic constructive elements 51.

In the specification, drawings, and examples, there have been disclosed typical embodiments of the invention and, although specific terms have been employed, they have been used in a generic and descriptive sense only and not for purposes of limitation, the scope of the invention being set forth in the following claims.

The invention claimed is:

1. An assembly for use in construction, said assembly comprising:

a first engaging member defining a geometric shape and at least one internal channel, said first engaging member having an internal surface and an external surface;

a second engaging member defining a geometric shape and at least one internal channel, said second engaging member having an internal surface and an external surface;

a first coupling member for connecting said first and second engaging members, said coupling member having an internal surface and an external surface and defining at least one internal channel; and a first elongate member defining an internal cavity and a cross section, said first elongate member having an internal surface, a first end, and a second end, wherein at least one end of said first elongate member is open for receiving said first engaging member;

a second elongate member defining an internal cavity and a cross-section, said second elongate member having an internal surface, a first end, and a second end, wherein at least one end of said second elongate member is open for receiving said second engaging member; and one or more controllers in communication with said first elongate member and said second elongate member, wherein the one or more controllers regulate an environment within each of said internal cavities of said first and second elongate members, the one or more controllers being a variety of controlling mechanisms to control the flow of various components through the assembly;

wherein said first engaging member is secured to said second engaging member by said first coupling member extending through each of said channels of said first and second engaging members;

wherein the assembly is in communication with a manifold assembly.

2. The assembly according to claim 1 wherein one or more geometric shapes of said first and second engaging members is selected from the group consisting of a sphere, a square, a cube, a rectangle, a trapezoid, a circle, a cone, an oval, a triangle, a pentagon, a hexagon, a heptagon, an octagon, and combinations thereof.

3. The assembly according to claim 1 wherein each of said internal surfaces of said first and second engaging members correspondingly engage said external surface of said first coupling member to secure said first engaging member to said second engaging member.

4. The assembly according to claim 1 further comprising:

a plurality of other coupling members having an internal surface and an external surface and defining a plurality of internal channels; and a plurality of other engaging members defining a geometric shape and a plurality of internal channels, said plurality of other engaging member having an internal surface and an external surface;

wherein said plurality of other coupling members connect said plurality of other engaging members to said first or second engaging members.

5. The assembly according to claim 1 wherein said internal surface of said first elongate member correspondingly engages said external surface of said first engaging member to secure said first elongate member to said first engaging member.

6. The assembly according to claim 1 wherein each of said internal channels of said first and second engagement members and said internal channel of said first coupling member are in communication with said internal cavity of said first elongate member.

7. The assembly according to claim 1 wherein one or more shapes of said cross-section of said first and second elongate member is selected from the group consisting of a square, a rectangle, a trapezoid, a circle, an oval, a triangle, a pentagon, a hexagon, a heptagon, an octagon, and combinations thereof.

8. The assembly according to claim 1 wherein said first and second elongate member is a construction element selected from the group consisting of a roofing element, a foundation element, a partition element, a wall element, and combinations thereof.

9. The assembly according to claim 1 wherein said first and second engaging member, said first coupling member, and a first elongate member and a second elongate member are made from material selected from the group consisting of wood, concrete, brick, tile, metal, fiberglass, particleboard, flakeboard, plywood, insulation board, fiberglass, cellulose, sawdust, natural fibers, mineral fibers, drywall, plaster, stucco, and combinations thereof.

* * * * *